US007094327B2

(12) United States Patent
Ardelean et al.

(10) Patent No.: US 7,094,327 B2
(45) **Date of Patent: *Aug. 22, 2006**

(54) COMPOSITIONS FOR THE TREATMENT OF MAGNESIUM ALLOYS

(75) Inventors: Hélène Ardelean, Palaiseau (FR); Philippe Marcus, Paris (FR)

(73) Assignee: Univeriste Pierre et Marie Curie, Paris (FR)

( * ) Notice: Subject to any disclaimer, the term of this patent is extended or adjusted under 35 U.S.C. 154(b) by 0 days.

This patent is subject to a terminal disclaimer.

(21) Appl. No.: 10/502,357

(22) PCT Filed: Jan. 31, 2003

(86) PCT No.: PCT/FR03/00313

§ 371 (c)(1),
(2), (4) Date: Jul. 23, 2004

(87) PCT Pub. No.: WO03/069026

PCT Pub. Date: Aug. 21, 2003

(65) Prior Publication Data

US 2005/0072685 A1 Apr. 7, 2005

(30) Foreign Application Priority Data

Feb. 13, 2002 (FR) ..... 02 01772

(51) Int. Cl.
*C25D 11/30* (2006.01)

(52) U.S. Cl. ..... 205/206; 205/199; 205/210; 205/224; 205/321

(58) Field of Classification Search ..... 205/321
See application file for complete search history.

(56) References Cited

U.S. PATENT DOCUMENTS 4,031,027 A 6/1977 Kessler
4,942,024 A * 7/1990 Sasaki et al. ..... 423/65
4,978,432 A * 12/1990 Schmeling et al. ..... 205/108

* cited by examiner

*Primary Examiner*—Roy King
*Assistant Examiner*—William T. Leader
(74) *Attorney, Agent, or Firm*—Buchanan Ingersoll & Rooney PC

(57) ABSTRACT

The invention relates to a composition for treating magnesium alloys aimed at improving the resistance thereof to corrosion. The composition is an aqueous solution with a pH ranging between 7 and 10, containing a niobium salt, hydrofluoric acid, and optionally a zirconium salt, phosphoric acid, and boric acid. The alloy is treated in an electrochemical cell in which said alloy acts as an anode. The cell contains an inventive composition at a temperature between 20° C. and 40° C. as an electrolyte. An initial voltage which is sufficient to create a current density between 1.5 and 2.5 $A/dm^2$ is applied to the cell, whereupon the voltage is progressively increased to a level ranging between 240 and 330 V in order to maintain the initial current density.

19 Claims, No Drawings

COMPOSITIONS FOR THE TREATMENT OF MAGNESIUM ALLOYS

BACKGROUND OF THE INVENTION

1. Field of the Invention:

The present invention relates to the treatment of magnesium alloys with a view to improving their corrosion resistance.

2. Description of the Related Art:

Magnesium alloys are of great benefit owing to their lightness. In particular, they are applicable in the transport (automobile and aeronautical) industries, medical equipment and mobile telephony. One of the weak points of these materials is their sensitivity to corrosion. Corrosion protection may be obtained by depositing a coating or by treating the surface. The protective layers may be produced either by chemical conversion or by anodizing in solutions containing metal salts and metalloids.

Anodizing treatments have been carried out in electrochemical cells in which the electrolyte contains a peroxide or a powerful oxidizing agent such as a chromate, a vanadate or a permanganate. One drawback of using such electrolytes lies in the fact that the transition metal ions are present, including some that are in the form of toxic species, for example $Cr^{6+}$. Other electrolytes not containing transition metals have been proposed. Thus, U.S. Pat. No. 4,978,432 describes the anodizing of parts made of a magnesium alloy using an electrolyte containing borate and/or sulfate anions introduced in acid form. However, the protective layer that forms on the surface of the magnesium alloy part has a high porosity, which impairs the effectiveness of the protection.

SUMMARY OF THE INVENTION

The inventors have found that, surprisingly, the use of an electrolyte containing a niobium salt in a method for the anodizing treatment of a magnesium alloy part allows an adherent protective layer of very low porosity to be obtained on the surface of said part.

It is for this reason that the subject of the present invention is a composition for the anodizing treatment of magnesium alloys, a method for treating the magnesium alloys using said composition, and the treated alloys obtained.

DETAILED DESCRIPTION OF THE PREFERRED EMBODIMENTS

A composition according to the invention for the anodizing treatment of a magnesium alloy is an aqueous solution containing a niobium salt, hydrofluoric acid, and optionally a zirconium salt, the pH of which solution is maintained at a value between 7 and 10, preferably between 8 and 9.5.

The niobium salt may be chosen from oxides and fluorides. Niobium pentoxide is particularly preferred.

It is preferable that the treatment composition be supersaturated with niobium pentoxide, corresponding to a concentration of 0.04 mol/l. Niobium pentoxide forms fluoroniobate (fluoroniobyl) complexes with hydrofluoric acid, these complexes decomposing water with evolution of hydrogen by being oxidized on the surface cathode sites. The magnesium ions formed on the anode sites react with the niobium complexes or complexes of other intermediate species to form, on the surface of the magnesium alloy, mixtures of hydrated niobium oxides (which are insoluble), of magnesium oxides, optionally of aluminum oxides and of other species.

Compositions containing a zirconium salt are preferred. The zirconium salt may be chosen from oxides and fluorides. $ZrF_4$ is particularly preferred.

The pH of the solution is controlled by the addition of compounds such as $NH_4OH$ or an amine (for example hexamethylenetetramine or hexamethylenediamine).

A treatment composition according to the invention may furthermore contain other constituents, especially other oxidizing agents such as phosphoric acid and boric acid.

In one particular embodiment, a composition according to the invention for the treatment of a magnesium alloy contains:

- from 0.01 to 0.04 mol/l of niobium pentoxide;
- from 20 to 50 ml/l of hydrofluoric acid;
- up to 0.04 mol/l of zirconium fluoride;
- from 50 to 70 g/l of $H_3PO_4$;
- from 30 to 70 g/l of $H_3BO_4$; and
- the required amount of a 28% aqueous ammonia ($NH_3$) solution for adjusting the pH to a value between 7 and 10, preferably between 8.5 and 9.

A composition according to the invention for the treatment of a magnesium alloy part may be obtained by dissolving, with stirring, the niobium salt in a solution containing hydrofluoric acid, then by adding, in succession, the zirconium salt, the phosphoric acid and then the boric acid in the form of an aqueous solution, and then the compounds intended to adjust the pH, the various steps being carried out with stirring for a time long enough to dissolve the compounds added.

More particularly, a composition according to the invention may be obtained by a multi-step method in which

- the niobium pentoxide is dissolved in a hot aqueous hydrofluoric acid solution (for example at 50° C.) and with stirring for about 10 hours;
- the zirconium salt is added and the mixture is left with stirring until the salts have dissolved;
- the phosphoric acid is introduced;
- the boric acid in the form of an aqueous solution is introduced; and
- the pH is adjusted to a value between 8.5 and 9 by the addition of a 28% aqueous ammonia solution or of an amine such as hexamethylenetetramine or hexamethylenediamine.

The method of treating a magnesium alloy according to the invention consists in making said alloy undergo electrolysis in an electrochemical cell in which said alloy functions as anode(+), characterized in that:

- the electrochemical cell contains, as electrolyte, a composition according to the invention at a temperature between 20° C. and 40° C.; and
- an initial voltage sufficient to create a current density between 1.5 and 2.5 A/dm$^2$, is applied to the cell and then the voltage is progressively increased up to a value between 240 and 330 V in order to maintain the initial current density.

The duration of the electrolysis is from 5 to 30 minutes, preferably from 15 to 25 minutes.

Preferably, a DC source connected in series to an AC source is used as power supply for the electrochemical cell so that the $I_{AC}/I_{DC}$ ratio is about 0.15 to 0.30.

It is desirable for the part to be protected to undergo a preliminary surface cleaning treatment before it is introduced into the electrolysis cell. This preliminary treatment may, for example, consist of a mechanical cleaning operation using abrasive disks such as SiC disks, followed by a degreasing operation in a hot phosphate/carbonate solution, and by a pickling operation in a dilute phosphoric acid/hydrofluoric acid solution or by a degreasing operation and a pickling operation.

A magnesium alloy part treated according to the method of the present invention has, on its surface, a hard adherent layer containing Zr, Mg and Nb oxides and also Mg and Zr fluorides, phosphates and borates.

The porosity of such a layer is substantially lower than the porosity of the layers obtained by the electrolytic treatment methods of the prior art. The low residual porosity may be further reduced by an additional treatment, called plugging. The treatment may consist of an alternation of steps in which the part is immersed in a bath and left in air, these steps being followed by annealing at $75^0$–150° C. in oxygen for a few hours. It is advantageous to use, for the plugging bath, an aqueous acid solution containing niobium pentoxide, a water-soluble cerium salt and a zirconium salt, more particularly a composition which has a pH of between 2.4 and 6 and which contains from 0.02 to 0.05 mol/l of niobium pentoxide, from 1 to 2.5 ml/l of hydrofluoric acid, at most 0.01 mol/l of a zirconium salt and from 0.03 to 0.1 mol/l of a water-soluble cerium salt. A preferred composition for the plugging bath is the following:

| | |
|---|---|
| HF (48% concentration): | 2.3 ml/l; |
| $Nb_2O_5$: | 0.04 mol/l; |
| $ZrO(NO_3)$; $2H_2O$: | 0.068 mol/l; |
| $Ce(NO_3)_3$; $6H_2O$: | 0.068 mol/l; |
| $NH_4F$ (97% concentration): | ~0.3 mol/l. |

The plugging may also be carried out in a hot $Na_2SiO_3$ solution, or with an epoxy/polyamide varnish (for example one sold under the name FREITAPOX®), or with an epoxy/polyamide paint (for example one sold under the name VIGOR EP®).

The layers thus obtained may serve as final protection layer or as substrate for a paint.

The magnesium alloy parts treated according to the method of the invention have, compared with an untreated part, an improved corrosion resistance. To confirm the improvement in corrosion resistance, specimens were subjected to voltammetry in a corrosive medium (for example in a 0.5 mol/l $Na_2SO_4$ solution with polarization). The curves representing the variation in the current as a function of the potential in a corrosive medium show a shift in the corrosion potential toward more positive values and a substantial reduction in the corrosion current and in the anode dissolution current compared with the untreated alloy.

The present invention will be described in greater detail with the aid of the following examples; however, it is not limited to these examples.

EXAMPLE 1

Preparation of a Treatment Composition

Introduced into about 150 ml of water were 34 ml of 48% HF, then 0.025 mol of $Nb_2O_5$ was added hot, and the mixture stirred for about 10 hours in order to dissolve the $Nb_2O_5$. Next, 0.03 mol of $ZrF_4$ was added hot, with stirring, and the stirring continued for about 24 hours in order to completely dissolve the $ZrF_4$. After the $ZrF_4$ had been completely dissolved, 60 g of $H_3PO_4$ were added, followed by 70 g of $H_3BO_4$ dissolved beforehand in water. The pH was adjusted to a value of 8.5–9 by adding a 28% aqueous ammonia solution and the amount of water needed to obtain one liter of solution was added.

Treatment of an Alloy

An AZ91D magnesium alloy was treated using the composition obtained above. The AZ91D alloy is a magnesium alloy containing 9% aluminum and 1% zinc.

The part to be treated was placed in an electrolysis-cell containing the above composition and said part was connected to the anode(+). The cathode was made of stainless steel. Next, a potential increasing up to a value between 240 and 330 V was applied between the anode and the cathode in order to maintain the current density at a value between 1.4 and 2 A/dm$^2$. The current was a DC current on which an AC current was superposed. The voltage was maintained for a period of 20 minutes. During anodizing, the treatment solution was stirred and the temperature was maintained in the 20–40° C. range by cooling.

Analysis of the Coating Obtained

The layer obtained on the surface of the treated part was dense, homogeneous and of low porosity. XPS analysis showed the presence of $ZrO_2$, $MgF_2$, MgO, $Nb_2O_5$ and $NbO_xF_y$, Mg phosphates and borates. The layer exhibited good adhesion to the alloy substrate.

Analysis of the Performance

The treated alloy part was subjected to measurements by voltammetry and by impedance spectroscopy in a 0.5 mol/l aqueous $Na_2SO_4$ solution with polarization. By way of comparison, the same measurements were carried out on the untreated AZ91D alloy and on the AZ91D alloy treated according to the method of the abovementioned U.S. Pat. No. 4,978,432. The curves obtained show that, in the case of the alloy treated according to the invention, the corrosion current and anode dissolution current are reduced compared with the untreated alloy and compared with the alloy treated according to the prior art. These results were confirmed by the impedance spectroscopy.

EXAMPLE 2

Preparation of a Treatment Composition 34 ml of 48% HF were introduced into about 150 ml of water, and heated, then 0.035 mol of $Nb_2Os$ was added and the mixture was subjected to magnetic stirring for about 10 hours in order to dissolve the $Nb_2O_5$. Next, 58 g of $H_3PO_4$ were added followed by 70 g of $H_3BO_4$ dissolved beforehand in water. The pH was adjusted to a value of 8.5–9 using a 28% aqueous ammonia solution and the total volume of the solution was made up to 1 liter by adding the appropriate amount of water.

Treatment of an Alloy

An AZ91D magnesium alloy identical to that used in Example 1 was treated under the conditions described in Example 1 using the above composition and then the treated parts were annealed at 150° C.

Analysis of the Coating Obtained

The layer obtained on the surface of the treated part is dense, homogeneous and of low porosity. XPS analysis shows the presence of $MgF_2$, MgO, $Nb_2O_5$ and $NbO_xF_y$, phosphates and borates. The layer exhibits good adhesion to the alloy substrate.

Analysis of the Performance

The treated alloy part was subjected to measurements by voltammetry and by impedance spectroscopy in a 0.5 mol/l aqueous $Na_2SO_4$ solution with polarization.

By way of comparison, the same measurements were carried out on the part treated according to Example 2 and then subjected to annealing at 150° C., on the same alloy treated according to the method of U.S. Pat. No. 4,978,432 and subjected to annealing. The curves show that, for the alloy treated according to the invention, the corrosion currents are reduced compared with the alloy treated according to the method of U.S. Pat. No. 4,978,432. These results were confirmed by the impedance spectroscopy.

The invention claimed is:

1. A composition for an anodizing treatment of a magnesium alloy, wherein the composition comprises an aqueous solution, containing a niobium salt and hydrofluoric acid, the pH of which solution is maintained at a value between 7 and 10, and wherein the niobium salt is an oxide or fluoride.

2. The composition as claimed in claim 1, wherein the niobium salt is niobium pentoxide.

3. The composition as claimed in claim 2, wherein the composition is supersaturated with niobium pentoxide.

4. The composition as claimed in claim 1, wherein the composition further comprises a zirconium salt.

5. The composition as claimed in claim 4, wherein the zirconium salt is an oxide or fluoride.

6. The composition as claimed in claim 4, wherein the zirconium salt is $ZrF_4$.

7. The composition as claimed in claim 1, wherein the pH is between 8 and 9.5.

8. The composition as claimed in claim 1, wherein the composition further comprises phosphoric acid and/or boric acid.

9. The composition as claimed in claim 1, wherein the composition further comprises $NH_4OH$ or an amine for maintaining the pH.

10. The composition as claimed in claim 1, wherein the composition comprises:

from 0.01 to 0.04 mol/l of niobium pentoxide;

from 20 to 50 ml/l of hydrofluoric acid;

up to 0.04 mol/l of zirconium fluoride;

from 50 to 70 g/l of $H3PO_4$;

from 30 to 70 g/l of $H3BO_4$; and the required amount of a 28% aqueous ammonia solution for adjusting the pH to a value between 7 and 10.

11. A method of treating a magnesium alloy comprising making said alloy undergo electrolysis in an electrochemical cell in which said alloy functions as anode(+), wherein:

the electrochemical cell contains, as electrolyte, a composition according to claim 10 at a temperature between 20° C. and 40° C.; and an initial voltage sufficient to create a current density between 1.5 and 2.5 A/dm$^2$, is applied to the cell and then the voltage is progressively increased up to a value between 240 and 330 V in order to maintain the initial current density.

12. A method of treating a magnesium alloy comprising making said alloy undergo electrolysis in an electrochemical cell in which said alloy functions as anode(+), wherein:

the electrochemical cell contains, as electrolyte, a composition according to claim 1 at a temperature between 20° C. and 40° C.; and an initial voltage sufficient to create a current density between 1.5 and 2.5 A/dm$^2$, is applied to the cell and then the voltage is progressively increased up to a value between 240 and 330 V in order to maintain the initial current density.

13. The method as claimed in claim 12, wherein a DC source connected in series to an AC source is used as power supply for the electrochemical cell so that the $I_{AC}/I_{DC}$ ratio is about 0.15 to 0.30.

14. The method as claimed in claim 12, wherein the duration of the electrolysis is from 5 to 30 minutes.

15. The method as claimed in claim 12, wherein, during a preliminary step, the alloy part to be treated is subjected to a surface cleaning operation.

16. The method as claimed in claim 15, wherein the surface cleaning operation is a mechanical cleaning operation using abrasive disks, followed by a degreasing operation in a hot phosphate/carbonate solution, and by a pickling operation in a dilute phosphoric acid/hydrofluoric acid solution; or a degreasing operation followed by a pickling operation.

17. The method as claimed in claim 12, wherein the electrolysis is followed by a plugging treatment.

18. The method as claimed in claim 17, wherein the plugging treatment consists of an alternation of steps in which the alloy part is immersed in a bath and then left in air, these steps being followed by annealing at 75°–150° C. in oxygen for a few hours.

19. The method as claimed in claim 18, wherein the plugging treatment is carried out using an aqueous acid solution containing niobium pentoxide, cerium nitrate and zirconyl nitrate; a hot aqueous $Na_2SiO_3$ solution; or an epoxy/polyamide varnish or an epoxy/amine paint.

* * * * *